US007868844B2

(12) United States Patent
Tsai et al.

(10) Patent No.: US 7,868,844 B2
(45) Date of Patent: Jan. 11, 2011

(54) ULTRA-WIDE BANDWIDTH ANTENNA

(75) Inventors: Tiao Hsing Tsai, Yungho (TW); Chao Hsu Wu, Tao Yuan Shien (TW); Chi Yin Fang, Pingtung (TW)

(73) Assignee: Quanta Computer Inc. (TW)

( * ) Notice: Subject to any disclaimer, the term of this patent is extended or adjusted under 35 U.S.C. 154(b) by 464 days.

(21) Appl. No.: 11/946,662

(22) Filed: Nov. 28, 2007

(65) Prior Publication Data

US 2008/0316107 A1 Dec. 25, 2008

(30) Foreign Application Priority Data

Jun. 21, 2007 (TW) ..... 96122265 A

(51) Int. Cl.
*H01Q 1/48* (2006.01)
*H01Q 1/24* (2006.01)
*H01Q 1/38* (2006.01)

(52) U.S. Cl. ..... 343/846; 343/702; 343/700 MS

(58) Field of Classification Search ..... 343/700 MS, 343/702, 846, 793, 795, 830
See application file for complete search history.

(56) References Cited

U.S. PATENT DOCUMENTS

| | | | | |
|---|---|---|---|---|
| 6,861,990 | B2 * | 3/2005 | Hung et al. | 343/702 |
| 6,917,334 | B2 * | 7/2005 | Chen | 343/700 MS |
| 7,106,256 | B2 * | 9/2006 | Watanabe et al. | 343/700 MS |
| 2002/0149538 | A1 * | 10/2002 | Tomomatsu et al. | 343/895 |
| 2006/0097926 | A1 * | 5/2006 | Fujii et al. | 343/700 MS |

* cited by examiner

*Primary Examiner*—Jacob Y Choi
*Assistant Examiner*—Robert Karacsony
(74) *Attorney, Agent, or Firm*—Banner & Witcoff, Ltd.

(57) ABSTRACT

An ultra-wide bandwidth antenna includes a dielectric substrate, first and second conductive elements, and a third conductive element. The dielectric substrate has opposite first and second surfaces. The first conductive element is formed on the second surface of the dielectric substrate and has a feeding point. The second conductive element is formed on the second surface of the dielectric substrate, is spaced apart from the first conductive element, and has a grounding point. The third conductive element is formed on the first surface of the dielectric substrate, partially overlaps the first conductive element, and is coupled electrically to the second conductive element.

4 Claims, 7 Drawing Sheets

Peak = 2.35 dBi, Avg. = -0.75 dBi.

Peak = 3.53 dBi, Avg. = -1.77 dBi.

Peak = 3.8 dBi, Avg. = -0.49 dBi.

ULTRA-WIDE BANDWIDTH ANTENNA

CROSS-REFERENCE TO RELATED APPLICATION

This application claims priority of Taiwanese application no. 096122265, filed on Jun. 21, 2007.

BACKGROUND OF THE INVENTION

1. Field of the Invention

This invention relates to an antenna, more particularly to an ultra-wide bandwidth antenna.

2. Description of the Related Art

Wireless communications facilitated by electronic devices, such as notebook computers, for both the wireless personal area network (WPAN) and the wireless local area network (WLAN) is experiencing increasing widespread use. Such wireless communications can be achieved by equipping the electronic devices with an ultra-wide bandwidth (UWB) antenna.

Typical planar inverted-F antennas (PIFAs) and monopole antennas includes a parasitic element to obtain ultra-wide bandwidth characteristics. These types of antennas, however, are bulky, have a complicated structure, and exhibit a low tolerance to frequency deviation.

SUMMARY OF THE INVENTION

Therefore, the object of the present invention is to provide an antenna that can overcome the aforesaid drawbacks of the prior art.

According to the present invention, an ultra-wide bandwidth antenna comprises a dielectric substrate, first and second conductive elements, and a third conductive element. The dielectric substrate has opposite first and second surfaces. The first conductive element is formed on the second surface of the dielectric substrate and has a feeding point. The second conductive element is formed on the second surface of the dielectric substrate, is spaced apart from the first conductive element, and has a grounding point. The third conductive element is formed on the first surface of the dielectric substrate, partially overlaps the first conductive element, and is coupled electrically to the second conductive element.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
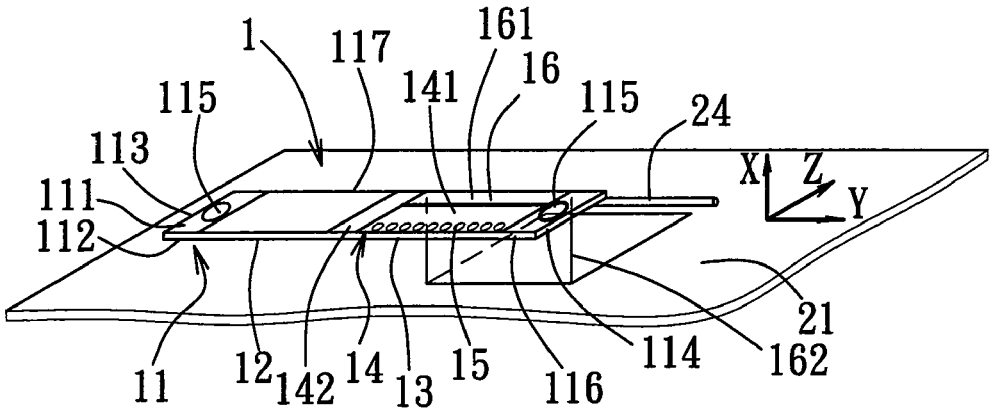
FIG. 1 is a perspective view of the preferred embodiment of an ultra-wide bandwidth antenna according to this invention.

Referring to FIG. 1, the preferred embodiment of an ultra-wide bandwidth (UWB) antenna 1 according to this invention is shown to include a dielectric substrate 11, first and second conductive elements 12, 13, and a third conductive element 14.

The UWB antenna 1 of this embodiment is suitable for wireless personal area network (WPAN) and wireless local area network (WLAN) applications. WPAN uses technology that operates between 2402 MHz and 2484 MGHz, such as Bluetooth, and between 3168 MHz and 4752 MHz, such as UWB Band I. WLAN, on the other hand, uses technology that operates between 2412 MHz and 2472 MHz, such as 802.11b/g compliant devices, and between 4900 MHz and 5875 MHz, such as 802.11a compliant devices.

Figure 2:
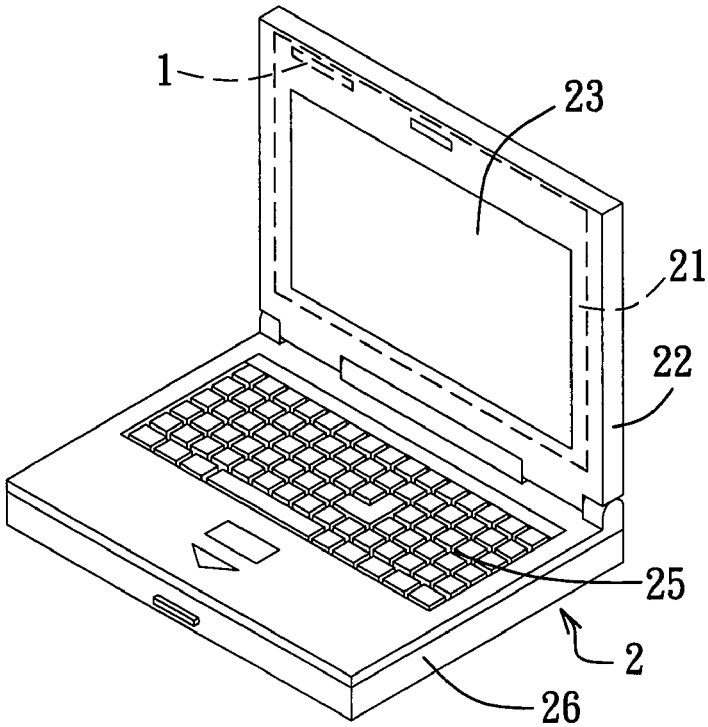
FIG. 2 is a perspective view illustrating the preferred embodiment mounted in an electronic device.

With further reference to FIG. 2, the UWB antenna 1 of this embodiment is mounted in an electronic device 2, such as a notebook computer. The electronic device 2 has a lower housing 26, a keyboard 25 mounted on the lower housing 26, an upper housing 22 coupled pivotably to the lower housing 26, a grounding plate 21 that serves as an electrical ground and that is mounted in the upper housing 22, and a liquid crystal display (LCD) 23 mounted on the grounding plate 21.

The UWB antenna 1 of this invention is disposed above the LCD 23 and proximate to an upper left corner of the upper housing 22 of the electronic device 2.

The dielectric substrate 11 is generally rectangular in shape, has first and second surfaces 111, 112 that are opposite to each other in a first direction (X), left and right ends 113, 114 that are opposite to each other in a second direction (Y) transverse to the first direction (X), and front and rear ends 116, 117 that are opposite to each other in a third direction (Z) transverse to the first and second directions (X, Y). In this embodiment, the dielectric substrate 11 has a thickness of 0.4 mm.

The UWB antenna 1 is secured to the upper housing 22 of the electronic device 2 with the use of a pair of screws (not shown). In particular, each of the left and right ends 113, 114 of the dielectric substrate 11 is formed with a hole 115 therethrough. Each of the screws is inserted through a respective one of the holes 115 and is threadedly engaged to the upper housing 22 of the electronic device 2.

Figure 3:
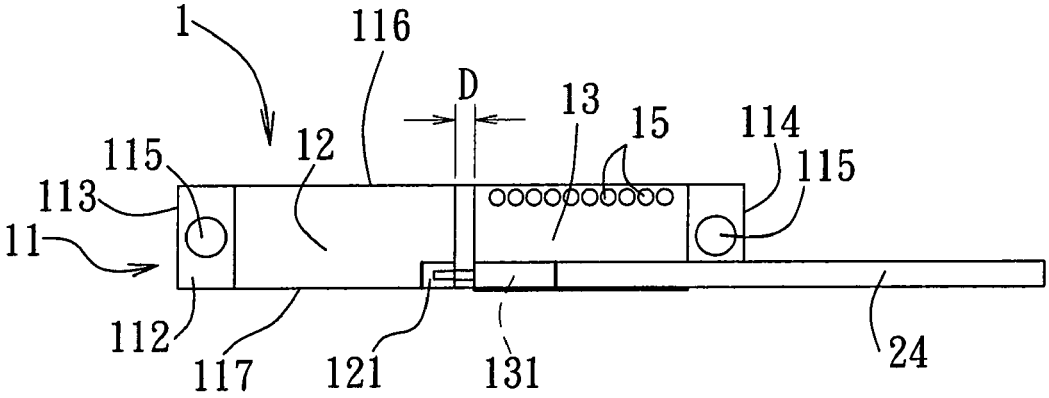
FIG. 3 is a schematic view illustrating first and second conductive elements of the preferred embodiment.

With further reference to FIG. 3, the first conductive element 12 is generally rectangular in shape, is formed on the second surface 112 of the dielectric substrate 11, is disposed proximate to the left end 113 and distal from the right end 114 of the dielectric substrate 11, and has a feeding point 121. In this embodiment, the first conductive element 12 has dimensions of 15.8 mm by 5 mm.

The second conductive element 13 is generally rectangular in shape, is formed on the second surface 112 of the dielectric substrate 11, is spaced apart from the first conductive element 12 to thereby define a distance (D) therebetween, is disposed proximate to the right end 114 and distal from the left end 113 of the dielectric substrate 11, and has a grounding point 131.

In this embodiment, the second conductive element 13 has dimensions of 15.3 mm by 5 mm.

The feeding point 121 and the grounding point 131 are disposed proximate to each other, and are connected to the electronic device 2 through a cable 24 to thereby permit the electronic device 2 to transmit and receive signals through the UWB antenna 1 of this invention.

Figure 4:
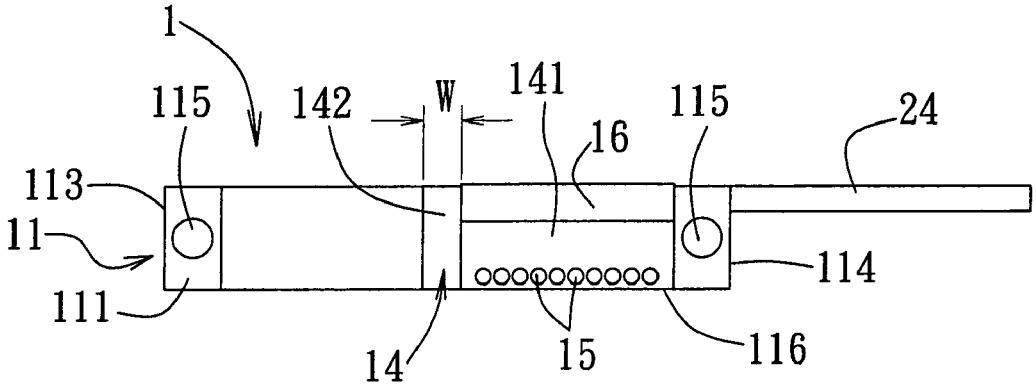
FIG. 4 is a schematic view illustrating a third conductive element of the preferred embodiment.

With further reference to FIG. 4, the third conductive element 14 is formed on the first surface 111 of the dielectric substrate 11, has a first end portion 141 that overlaps the second conductive element 13, and a second end portion 142 that extends from the first end portion 141 thereof. In this embodiment, the third conductive element 14 has dimensions of 17.3 mm by 5 mm. The overlapping area between the second conductive element 13 and the first end portion 141 of the third conductive element 14 is 2.5 $mm^2$. The second portion 142 of the third conductive element 14 has a width (W).

"Overlap" as used herein refers to positional correspondence between elements along the first direction (X) with the dielectric substrate 11 interposed therebetween.

It is noted that the width (W) of the second end portion 142 of the third conductive element 14 is larger than the distance (D) defined between the first and second conductive elements 12, 13 to thereby permit the second end portion 142 of the third conductive element 14 to partially overlap the first conductive element 12. In this embodiment, the distance (D) defined between first and second conductive elements 12, 13 is 1.5 mm, and the width (W) of the second end portion 142 of the third conductive element 14 is 2 mm.

The UWB antenna 1 further includes a plurality of via holes 15 that are disposed along the front end 116 of the dielectric substrate 11. In this embodiment, each of the via holes 15 extends from the second conductive element 13, through the dielectric substrate 11, and to the first end portion 141 of the third conductive element 14.

Each of the via holes 15 is filled with conductive material (not shown) so as to make an electrical connection between the second and third conductive elements 13, 14, in a manner well known in the art.

The UWB antenna 1 further includes a copper foil 16 that has first and second ends 161, 162. As best shown in FIG. 1, the first end 161 of the copper foil 16 is disposed at the rear end 117 of the dielectric substrate 11, and is connected to, i.e., lies on, the first end portion 141 of the third conductive element 14. The second end 162 of the copper foil 16 is connected to the grounding plate 21.

It is noted herein that the first conductive element 12 serves as a radiating element of the UWB antenna 1 of this invention, while the second and third conductive elements 13, 14 constitute a grounding element of the UWB antenna 1 of this invention. As such, resonance and coupling between the radiating element 12 and the grounding element 13, 14 of the UWB antenna 1 of this invention may be adjusted by simply varying the dimensions of the first and second conductive elements 12, 13. Moreover, in order to increase an antenna impedance of the UWB antenna 1 of this invention, capacitance coupling between the first and third conductive elements 12, 14 may be adjusted by simply varying the width (W) of the second end portion 142 of the third conductive element 14, thereby permitting the UWB antenna 1 of this invention to obtain ultra-wide bandwidth characteristics.

TABLE I

| Frequency (GHz) | TRP (dB) | Radiation Efficiency (%) |
|---|---|---|
| 2.402 | −1.48 | 71.08 |
| 2.440 | −0.96 | 80.15 |
| 2.480 | −1.05 | 78.60 |
| 3.168 | −1.24 | 75.09 |
| 3.432 | −1.43 | 71.91 |
| 3.696 | −1.29 | 74.28 |
| 3.960 | −0.80 | 83.19 |
| 4.224 | −1.36 | 73.13 |
| 4.488 | −2.49 | 56.34 |
| 4.752 | −1.88 | 64.80 |

TABLE II

| Frequency (GHz) | TRP (dB) | Radiation Efficiency (%) |
|---|---|---|
| 2.412 | −0.97 | 80.07 |
| 2.437 | −0.74 | 84.26 |
| 2.462 | −0.50 | 89.19 |
| 4.900 | −2.71 | 53.54 |
| 5.150 | −1.63 | 68.73 |
| 5.350 | −1.46 | 71.44 |
| 5.470 | −1.07 | 78.08 |
| 5.725 | −1.49 | 70.93 |
| 5.825 | −1.64 | 68.61 |

Figure 5:
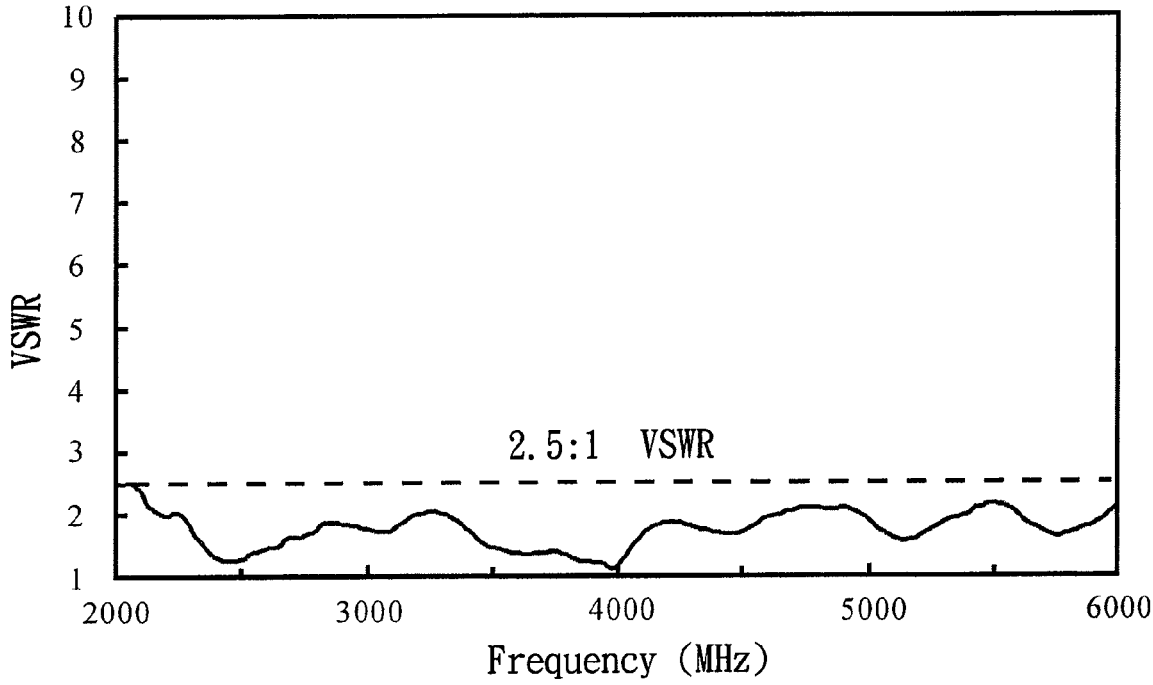
FIG. 5 is a plot illustrating a voltage standing wave ratio (VSWR) of the preferred embodiment when operated between 2 GHz and 6 GHz.
Figure 6:
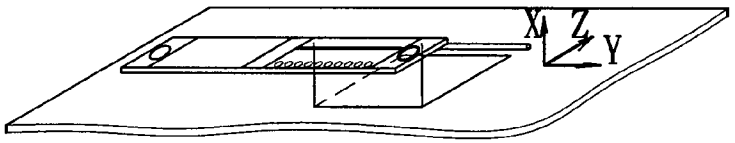
FIG. 6 shows plots of radiation patterns of the preferred embodiment respectively on the x-y, x-z, and y-z planes when operated at 2.440 GHz.
Figure 6:
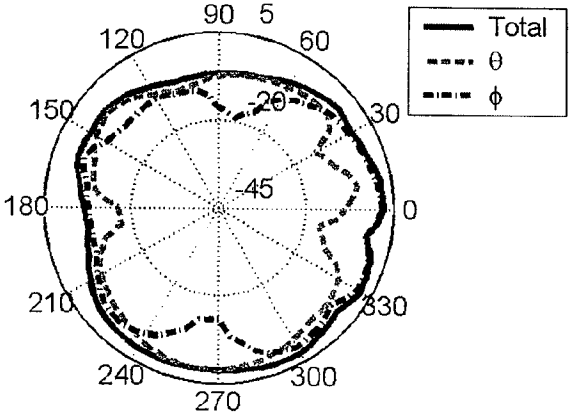
Figure 6:
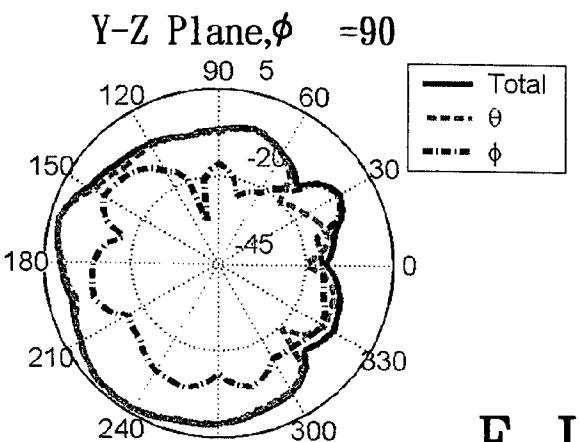
Figure 6:
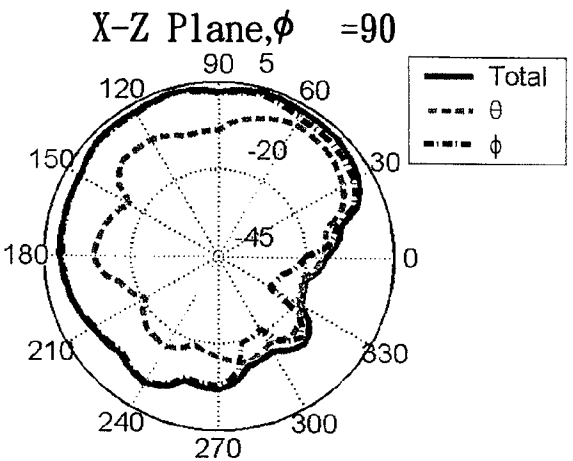
Figure 7:
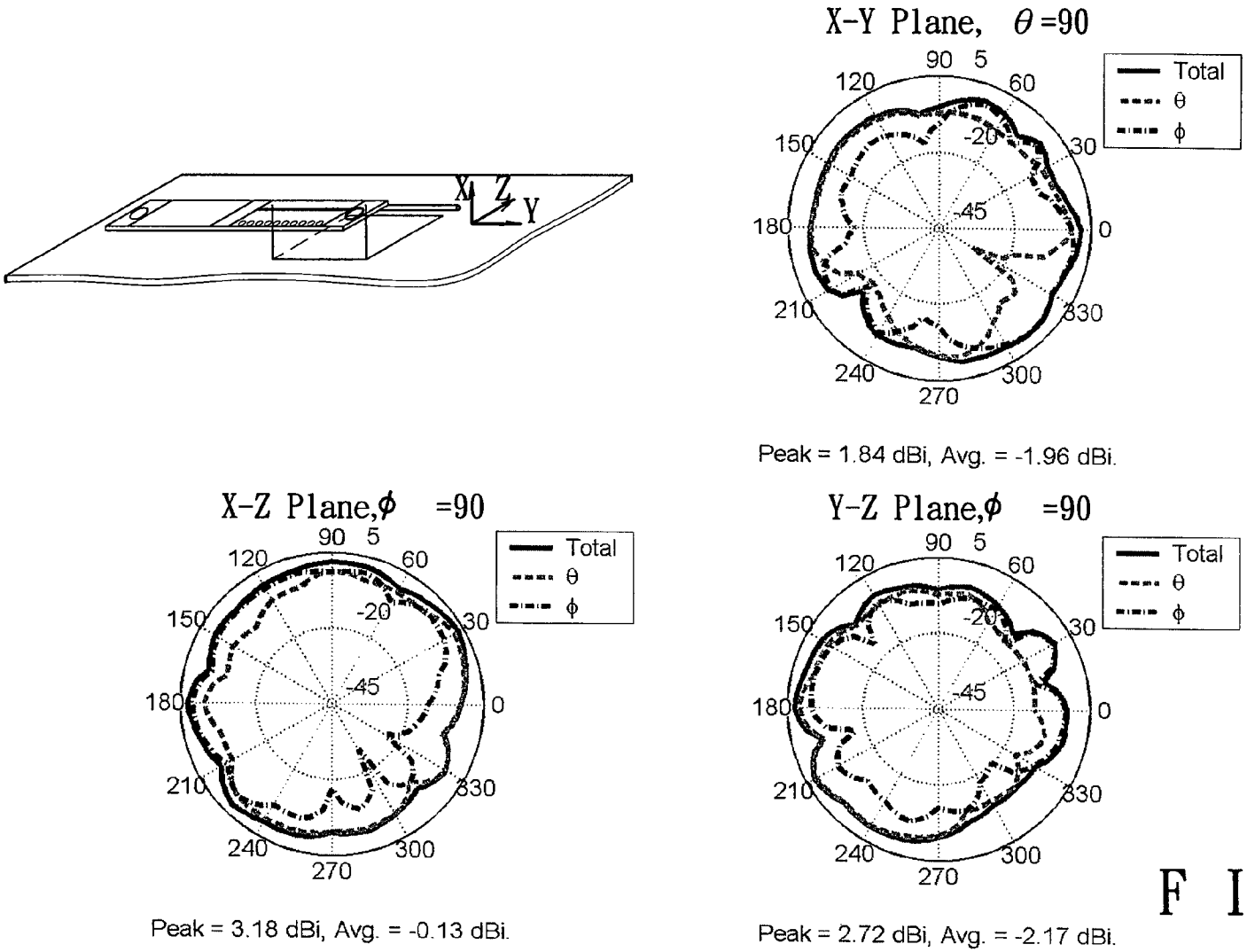
FIG. 7 shows plots of radiation patterns of the preferred embodiment respectively on the x-y, x-z, and y-z planes when operated at 4.224 GHz.
Figure 8:
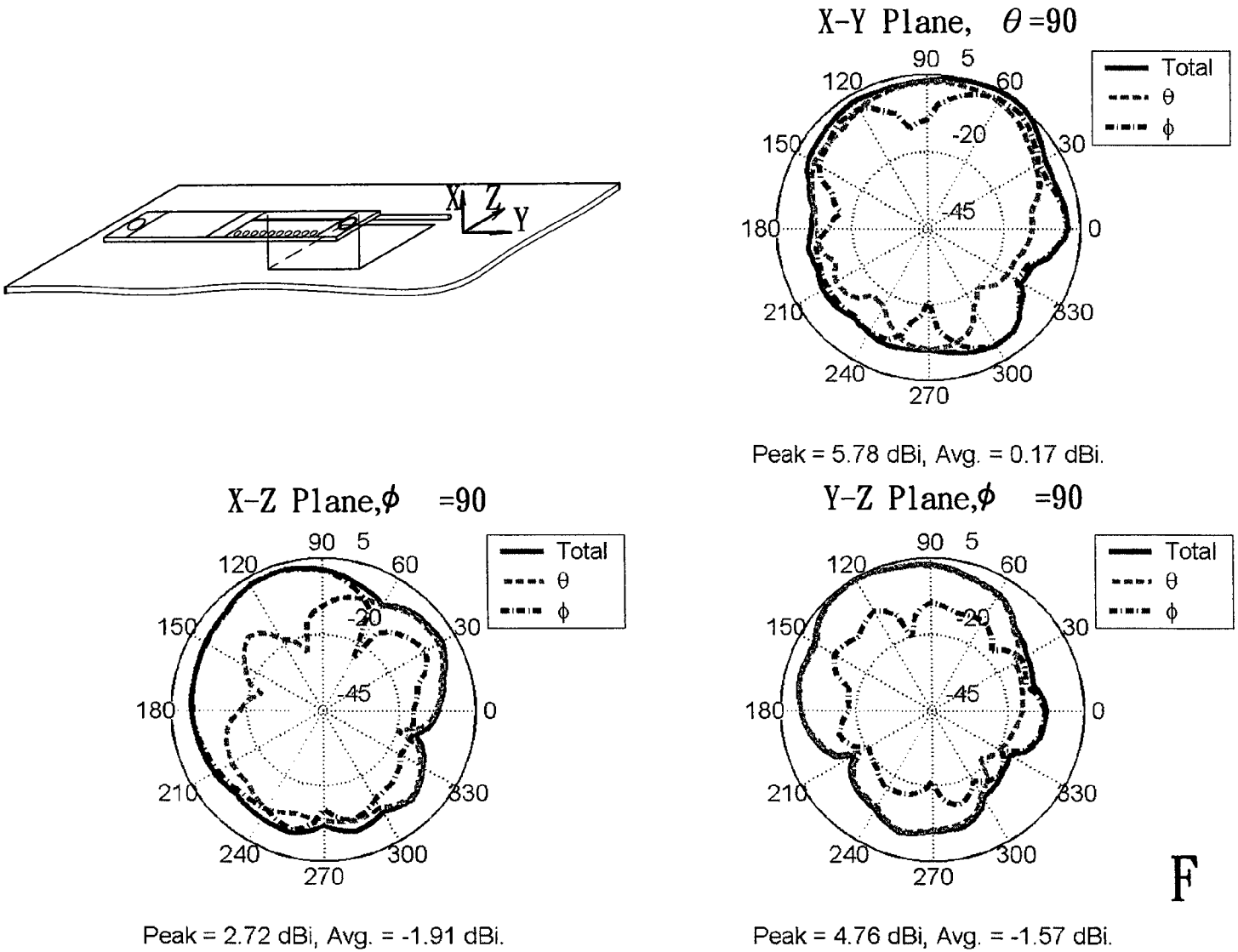
FIG. 8 shows plots of radiation patterns of the preferred embodiment respectively on the x-y, x-z, and y-z planes when operated at 2.437 GHz.
Figure 9:
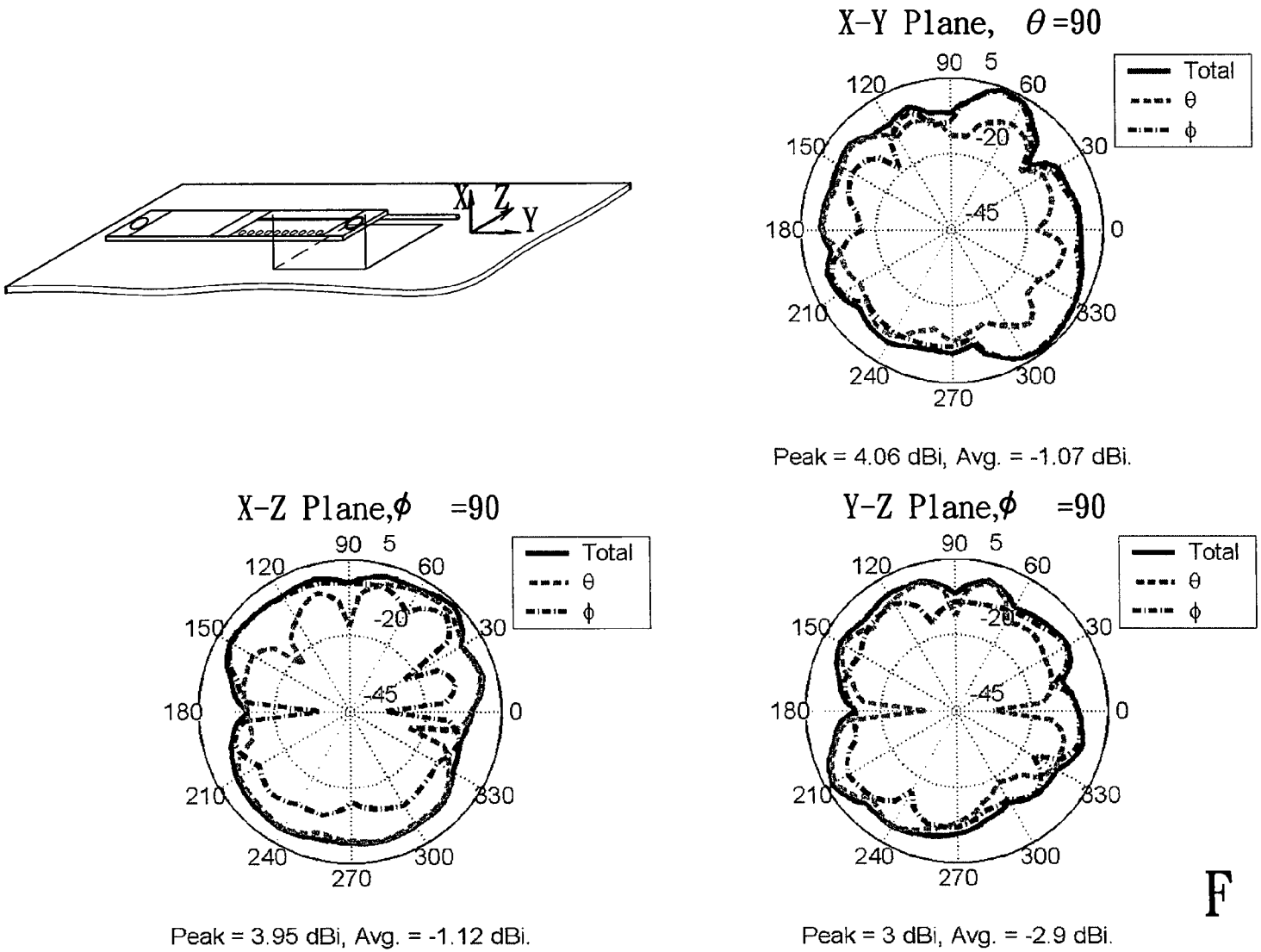
FIG. 9 shows plots of radiation patterns of the preferred embodiment respectively on the x-y, x-z, and y-z planes when operated at 5.470 GHz.

Based on experimental results, as illustrated in FIG. 5, the UWB antenna 1 of this invention achieves a voltage standing wave ratio (VSWR) of less than 2.5. Moreover, as illustrated in FIGS. 6, 7, 8, and 9, the UWB antenna 1 of this invention embodiment has substantially omnidirectional radiation patterns. Further, as shown in Table I, the UWB antenna 1 of this invention, when operated between 2.402 GHz and 4.752 GHz, achieves satisfactory total radiation powers and radiation efficiencies. In addition, as shown in Table II, the UWB antenna 1 of this invention, when operated between 2.412 GHz and 5.875 GHz, also achieves satisfactory total radiation powers and radiation efficiencies. Hence, it is clear that the UWB antenna 1 of this invention is indeed suitable for WPAN and WLAN applications.

It is noted that since the UWB antenna 1 of this invention is suitable for both WPAN and WLAN applications, this enables a manufacturer to mass produce the UWB antenna 1 of this invention, thereby lowering production costs. Moreover, due to the inherent large bandwidth of the UWB antenna 1 of this invention, the UWB antenna 1 of this invention exhibits a high tolerance to frequency deviation.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An ultra-wide bandwidth antenna, comprising:

a dielectric substrate having opposite first and second surfaces;

a first conductive element formed on said second surface of said dielectric substrate and having a feeding point;

a second conductive element formed on said second surface of said dielectric substrate, spaced apart and electrically separated from said first conductive element, and having a grounding point; and a third conductive element formed on said first surface of said dielectric substrate, partially overlapping said first conductive element, and coupled electrically to said second conductive element; and a copper foil connected to said third conductive element and adapted to be connected to an electrical ground.

2. The ultra-wide bandwidth antenna as claimed in claim 1, wherein said third conductive element has a first end portion that overlaps said second conductive element, and a second end portion that partially overlaps said first conductive element.

3. The ultra-wide bandwidth antenna as claimed in claim 1, further comprising a plurality of via holes for making an electrical connection between said second and third conductive elements, each of said via holes extending from said second conductive element, through said dielectric substrate, and to said third conductive element.

4. The ultra-wide bandwidth antenna as claimed in claim 1, wherein said dielectric substrate is formed with a hole therethrough.

* * * * *